US009043152B2

(12) United States Patent
Schuberth et al.

(10) Patent No.: US 9,043,152 B2
(45) Date of Patent: May 26, 2015

(54) REALTIME DOGLEG SEVERITY PREDICTION

(75) Inventors: Frank Schuberth, Celle (DE); Hanno Reckmann, Nienhagen (DE); John D. Macpherson, Spring, TX (US); James Albert Hood, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 330 days.

(21) Appl. No.: 13/204,964

(22) Filed: Aug. 8, 2011

(65) Prior Publication Data

US 2013/0041586 A1 Feb. 14, 2013

(51) Int. Cl.
*G01V 1/40* (2006.01)
*E21B 47/022* (2012.01)

(52) U.S. Cl.
CPC ..... *E21B 47/022* (2013.01)

(58) Field of Classification Search
CPC ..... G06F 19/00
USPC ..... 702/6
See application file for complete search history.

(56) References Cited

U.S. PATENT DOCUMENTS

| | | | | |
|---|---|---|---|---|
| 4,733,733 | A * | 3/1988 | Bradley et al. | 340/853.4 |
| 4,747,303 | A | 5/1988 | Fontenot | |
| 5,202,680 | A | 4/1993 | Savage | |
| 8,210,283 | B1 * | 7/2012 | Benson et al. | 175/61 |
| 8,286,729 | B2 * | 10/2012 | Reckmann et al. | 175/45 |
| 2003/0075361 | A1 * | 4/2003 | Terry et al. | 175/61 |
| 2005/0150689 | A1 * | 7/2005 | Jogi et al. | 175/45 |
| 2005/0268476 | A1 * | 12/2005 | Illfelder | 33/313 |
| 2006/0106588 | A1 | 5/2006 | Mitchell | |
| 2008/0275648 | A1 * | 11/2008 | Illfelder | 702/7 |
| 2009/0000823 | A1 * | 1/2009 | Pirovolou | 175/61 |
| 2009/0084546 | A1 * | 4/2009 | Ekseth et al. | 166/255.1 |
| 2009/0205867 | A1 * | 8/2009 | Reckmann et al. | 175/24 |
| 2012/0016589 | A1 * | 1/2012 | Li et al. | 702/9 |
| 2012/0018225 | A1 * | 1/2012 | Peter et al. | 175/61 |
| 2012/0330551 | A1 * | 12/2012 | Mitchell et al. | 702/9 |

FOREIGN PATENT DOCUMENTS

EP 1709293 A1 10/2006

OTHER PUBLICATIONS

Heisig, G., et al.; "Bending Tool Face Measurments While Drilling Delivers New Directional Information, Improved Directional Control"; IADC/SPE 128789; p. 1-11; 2010.

(Continued)

*Primary Examiner* — Sujoy Kundu
*Assistant Examiner* — Alvaro Fortich
(74) *Attorney, Agent, or Firm* — Cantor Colburn LLP

(57) ABSTRACT

A method for estimating an inclination and azimuth at a bottom of a borehole includes forming a last survey point including a last inclination and a last azimuth; receiving at a computing device bending moment and at least one of a bending toolface measurement and a near bit inclination measurement from one or more sensors in the borehole; and forming the estimate by comparing possible dogleg severity (DLS) values with the bending moment value.

8 Claims, 4 Drawing Sheets

(56) References Cited

OTHER PUBLICATIONS

Vaughan, J. K., et al.; "Superior Horizontal Well Placement Yields Impressive Production Increase in Mature Field by Using Multi-Disciplined Approach Combining Deep-Azimuthal Resistivity and Continuous Survey Monitoring Using Down-Hole Bending Moment and Bending Tool-Face Measurements in a Rotary Steerable Drilling System"; SPWLA 52nd Annual Logging Symposium; p. 1-15; May 14-18, 2011.

Notification of Transmittal of the International Search Report and the Written Opinion of the International Searching Authority, or the Declaration; PCT/US2012/049430; Feb. 25, 2013.

* cited by examiner

REALTIME DOGLEG SEVERITY PREDICTION

BACKGROUND OF THE INVENTION

1. Field of the Invention

This invention relates to drilling and, more specifically, to systems and methods for determining the curvature of the wellbore by considering the bending of the drill string.

2. Description of the Related Art

Various types of drill strings are deployed in a borehole for exploration and production of hydrocarbons. A drill string generally includes drill pipe and a bottom hole assembly. The bottom hole assembly contains drill collars, which may be instrumented, and can be used to obtain measurements-while-drilling or while-logging, for example.

Some drill strings can include components that allow the borehole to be drilled in directions other than vertical. Such drilling is referred to in the industry as "directional drilling." While deployed in the borehole, the drill string may be subject to a variety of forces or loads. Because the drill string is in the borehole, the loads are only measured at certain sensor positions and can affect the static and dynamic behavior and direction of travel of the drill string.

Either planned (directional drilling) trajectory changes, the loads experienced during drilling or formation changes can lead to the creation of a dogleg in the borehole. A dogleg is a section in a borehole where the trajectory of the borehole, its curvature changes. The rate of trajectory change is called dogleg severity (DLS) and is typically expressed in degrees per 100 feet.

BRIEF SUMMARY OF THE INVENTION

Disclosed is a computer-based method for estimating an inclination and azimuth at a bottom of a borehole. The method includes forming a last survey point including a last inclination and a last azimuth; receiving at a computing device bending moment and at least one of a bending toolface measurement and a near bit inclination measurement from one or more sensors in the borehole; and forming the estimate by comparing possible dogleg severity (DLS) values with the bending moment value.

Further disclosed is a computer program product for estimating an inclination and azimuth at a bottom of a borehole. The computer program product includes a tangible storage medium readable by a processing circuit and storing instructions for execution by the processing circuit for performing a method comprising: receiving a last survey point including a last inclination and a last azimuth; receiving at least a bending moment measurement and one of a bending toolface measurement and a near bit inclination measurement from one or more sensors in the borehole; and forming the estimate by comparing possible dogleg severity (DLS) values with the bending moment value.

Also disclosed is a system for estimating an inclination and azimuth at a bottom of a borehole. The system includes a drill string including a sensor sub, the sensor sub including one or more sensors for measuring bending moment at least one of a bending toolface and a nea bit inclination. The system also includes a computing device in operable communication with the one or more sensors and configured to receive bending moment and at least one of a bending toolface measurement and a near bit inclination measurement from one or more sensors in the borehole and form the estimate by comparing possible dogleg severity (DLS) values with the bending moment value.

BRIEF DESCRIPTION OF THE DRAWINGS

The subject matter, which is regarded as the invention, is particularly pointed out and distinctly claimed in the claims at the conclusion of the specification. The foregoing and other features and advantages of the invention are apparent from the following detailed description taken in conjunction with the accompanying drawings, wherein like elements are numbered alike, in which:

DETAILED DESCRIPTION OF THE INVENTION

Disclosed are exemplary techniques for estimating or predicting the DLS and location of the bottom of a borehole. The techniques, which include systems and methods, use measurements of a bending moments experienced in the bottom hole assembly (BHA) of a drill string to predict the inclination and azimuth at the bit.

Figure 1:
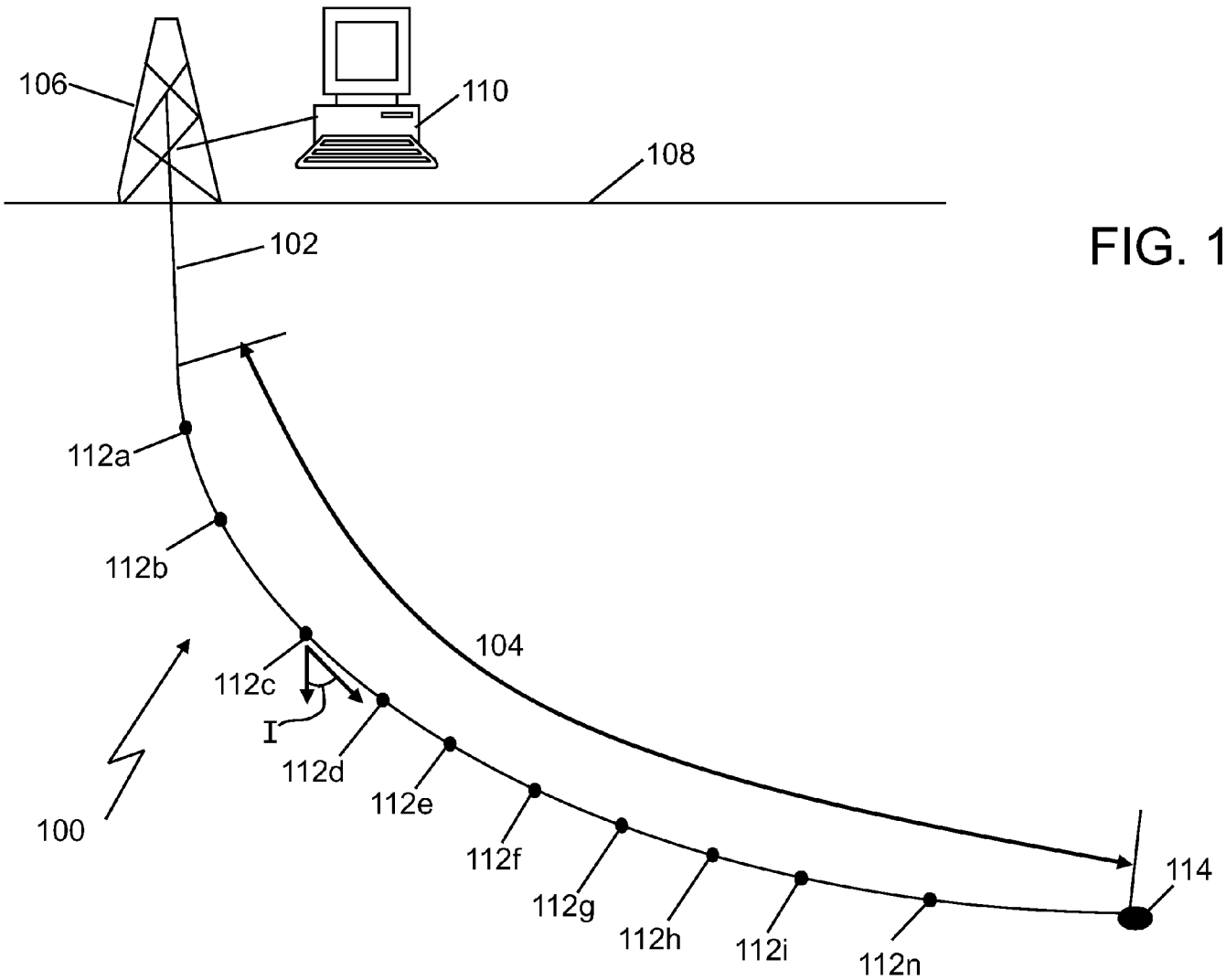
FIG. 1 illustrates a borehole that includes a dogleg.

FIG. 1 illustrates a borehole 100 that includes a substantially vertical section 102 and a curved section 104. The borehole 100 can be drilled by a rig 106 that drives a drill string (not shown) such that it penetrates the surface 108. The borehole 100 can be drilled with either conventional or directional drilling techniques.

Information from within the borehole 100 can be provided either while drilling (e.g., logging-while-drilling (LWD)) or by wireline measurement applications. Regardless of the source, the information is provided to one or more computing devices generally shown as a processing unit 110. The processing unit 110 may be configured to perform functions such as controlling the drill string, transmitting and receiving data, processing measurement data, and performing simulations of the drilling operation using mathematical models. The processing unit 110, in one embodiment, includes a processor, a data storage device (or a computer-readable medium) for storing, data, models and/or computer programs or software that can be used to perform one or more the methods described herein.

While drilling, it is important to be able to estimate the trajectory of the borehole 100 to check it against the planned one. However, the directional surveys are usually measured every 30 m and have an offset to the bit. In FIG. 1, the location of directional surveys are indicated by survey points 112*a*-112*n*. Each survey point 112 includes a measurement of the inclination and azimuth. In particular, the inclination (I) is measured from vertical and the azimuth is the compass heading measured from a fixed direction (e.g., from North).

Taking surveys at each survey point 112 typically requires stopping drilling. In some cases, the tools used to form the survey points 112 are located at a distance of up to 30 meters behind the drill bit located at the bottom 114 of the borehole 102. Given such constraints, a new local doglegs can be formed between the last survey point 112*n* and the bottom 114 of the borehole. That is, the trajectory of curved portion 104 of the borehole 100 may not be known, while drilling, between the last survey point 112 and the bottom 114 where the bit is located.

As is generally known in the art, the processing unit 110 can receive sensor data in real time from sensors located at one or more locations along a drill string. This data is typically used to monitor drilling and to help an operator efficiently control the drilling operation. One such sensor can measure the bending moment at a certain position in the drill string (e.g., the BHA) while drilling or while the drill string is at rest.

Figure 2:
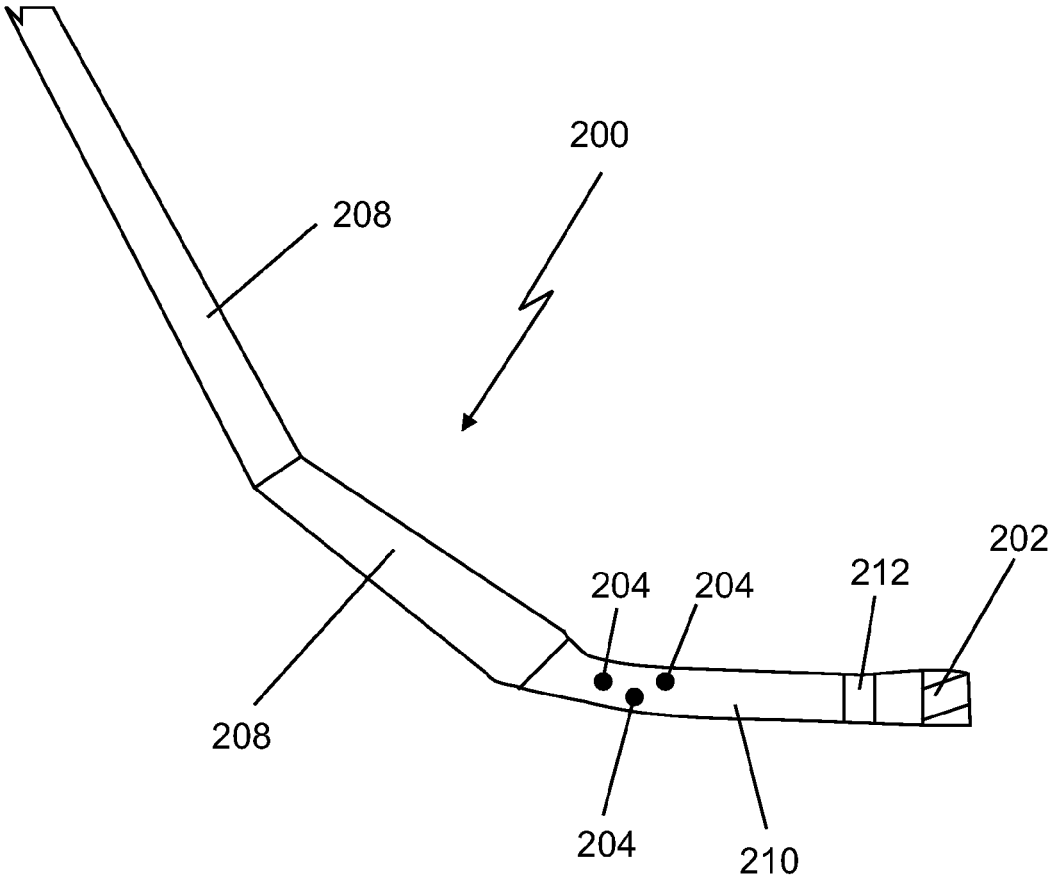
FIG. 2 illustrates an example of a drill sting according to one embodiment.

FIG. 2 illustrates a drill string 200 that can be used to drill, for example, the borehole 100 of FIG. 1. The drill string 200 includes a bit 202 at a distal end and one or more sensors 204 disposed apart from the bit 202. In the illustrated embodiment, the drill string includes a plurality of pipe segments 208. The drill string 100 also includes a sensor sub 210 coupled to one of the segments 208. The combination of the pipe segments 208 and the sensor sub 219 span from the surface to the drill bit 202. Of course, other components such as a mud motor 212 that drives bit 202 could be included along the length of the drill string 200. As illustrated, sensors 204 are located on the sensor sub 210 but one of ordinary skill will realize that the sensors 202 could be located at any location along the drill string 200.

One or more of the sensors 204 is in realtime communication with a computing device (e.g., processing unit 110 of FIG. 1) in known manners. For example, the sensors 204 could provide data to the processing unit 110 via mud pulse telemetry or via a wired-pipe connection. According to one embodiment, at least one of the sensors 204 can measure the bending moment of the section of pipe (e.g., the sensor sub 204) to which it is coupled or to an assembly that includes that section of pipe (e.g. a BHA that comprises at least the bit 202 and the sensor sub 210). This measurement represents the bending stresses in the sensor sub 210/BHA caused by the borehole curvature, gravity and other forces and loads. In one embodiment, the bending moment is transferred such that it includes additional the bending tool face. The bending toolface defines the direction of the bend and the bending moment defines the amount the sensor sub 210/BHA is bent. According to one embodiment, the bending moment and at leat one of the bending toolface and near bit inclination can be used to predict inclination and azimuth at the bit 202. Such a prediction, can include considerations of the last posted survey (e.g. survey point 212*n*), weigh on bit (WOB), torque on bit (TOB), steer force and motor orientation to name but a few. Of course, the sensors 204 could measure these and other values and provide them to the processing unit 210. For the prediction i.e. a finite element model as described in Heisig/Neubert (IADC SPE 59235) may be used.

Figure 3:
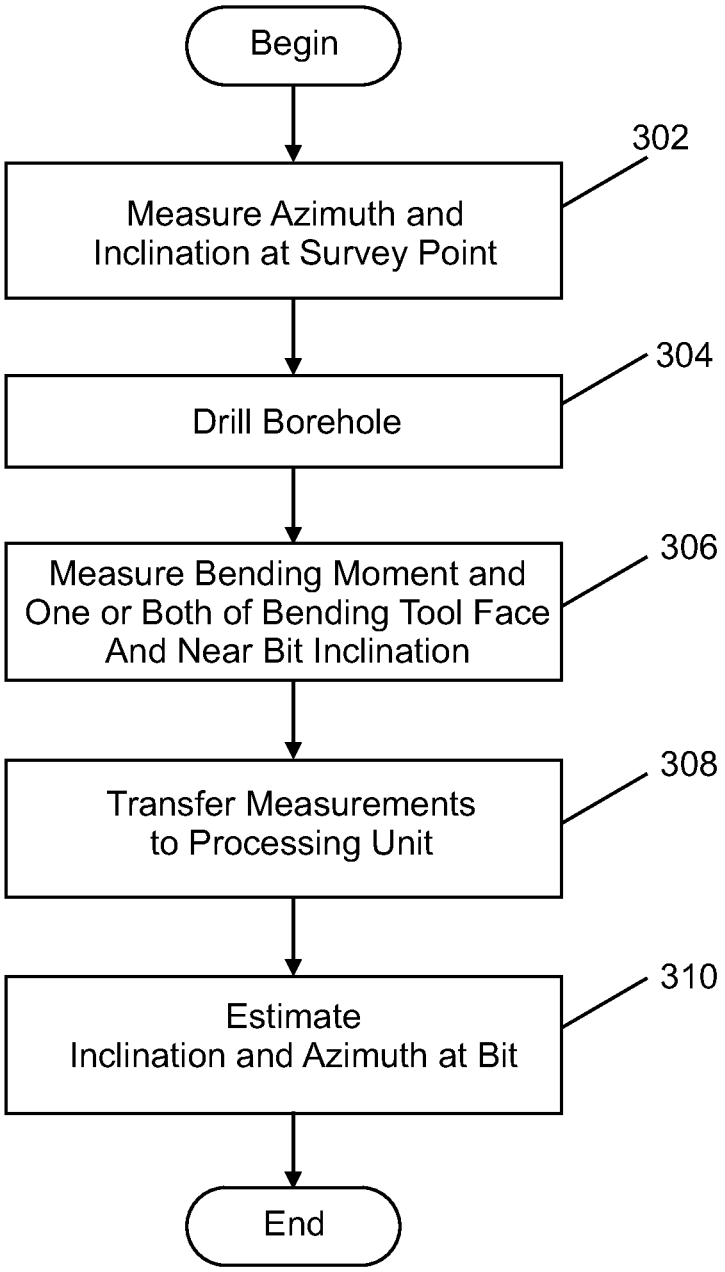
FIG. 3 is a flow chart showing a method according to one embodiment.

FIG. 3 is flow chart illustrating a method of estimating the inclination and azimuth at the bit of a drill string. The drill string includes one or more sensor capable of measuring a bending moment and, in some cases, also a toolface orientation.

At block 302 the azimuth and inclination of a last survey point are measured. Such a measurement can be made in any now known or later developed manner. At block 304, drilling of the borehole from the last survey point is commenced. At block 306, bending moment and one or both of the near bit inclination and the bending tool face are measured. These measurements can be continuous or periodic and can occur while drilling or during times when drilling is halted.

The data measured at block 308 is transferred to a processing unit that is located either at the surface or that is part of the drill string. The data can be transferred periodically in batches or as it is measured depending on the speed of the data link between the sensors and the processing unit.

At block 310, the processing unit can estimate the inclination and azimuth at the bit. The process is described further below but generally includes consideration of the last sample point, the bending moment and one or both of the bending tool face and the near bit inclination (measurement of inclination by a sensor based on accelerometers located very close to the bit). Given the teachings herein, one of ordinary skill will realize that if a near bit inclination is available, only bit azimuth is unknown and, thus, only a measurement of bending moment is required. However, having bending tool face and near bit inclination available at the same, more accurate results can be achieved because the system is better known.

Figure 4:
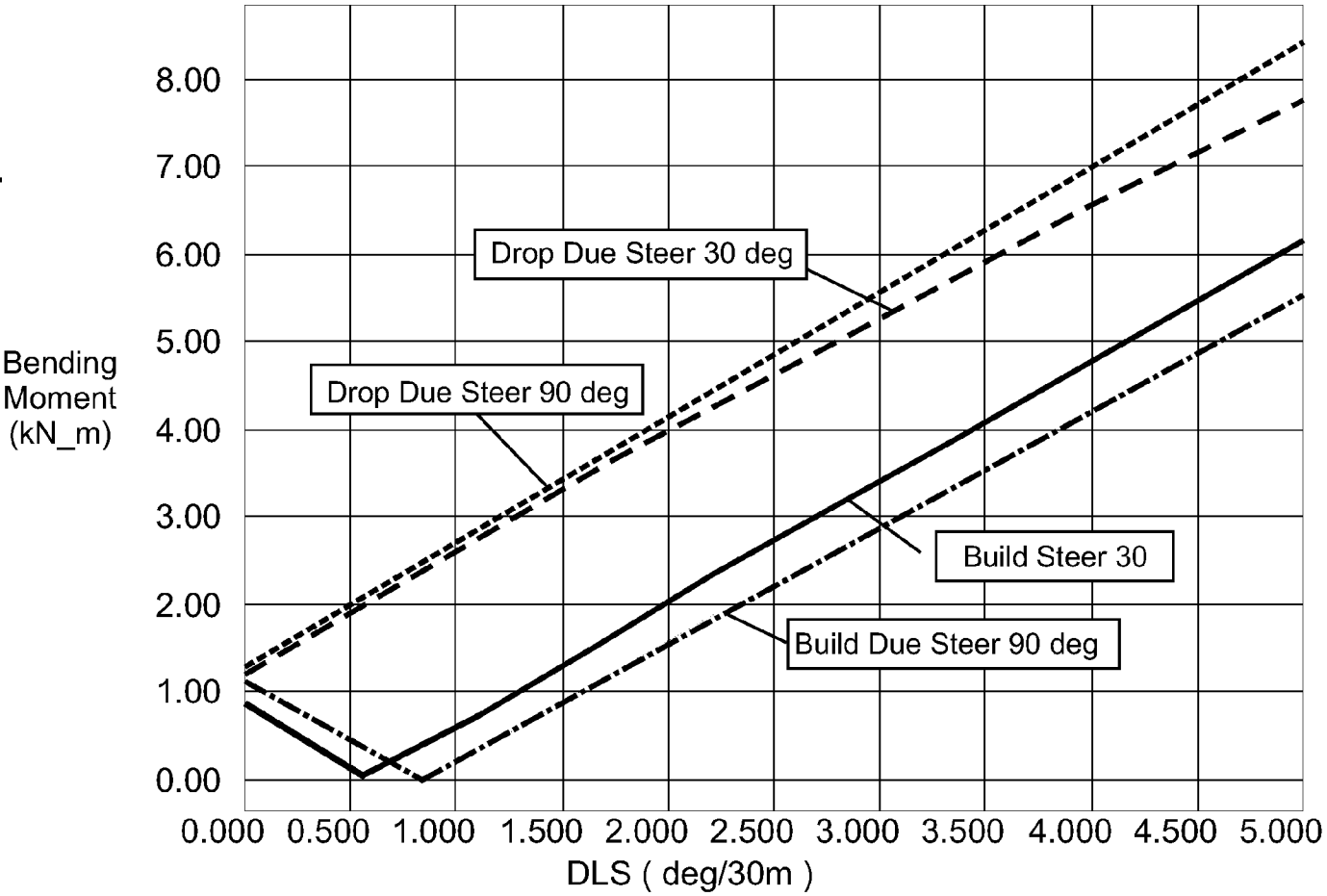
FIG. 4 graphically illustrates a relationship between dogleg severity and measured bending moments.

FIG. 4 illustrates actual dogleg severity (e.g., change in direction per 30 meters) plotted against a measured bending moment for several different operating conditions. In particular, it can be seen that regardless of the conditions, there is an almost linear relationship between the DLS and the measured bending moment. A graph such as FIG. 4, therefore, can be used to convert a DLS to a measured bending moment. According to one embodiment, an estimate of the inclination and azimuth at the bit can be repeatedly varied to get different DLS values. The possible DLS values can be formed, for example, by creating possible inclination and azimuth values for the bottom of the hole and comparing them with the last inclination and last azimuth. The inclination and azimuth that forms a DLS that corresponds to the measured bending moment is then selected as the actual inclination and azimuth at the bit.

According to one embodiment, the bending tool face can be used to set the plane in which the drill string is bending from the last sample point to the bit. That is, and referring again to FIG. 1, according to one embodiment, the bending tool face defines the plane in which it is estimated that all travel and bending will occur between the last sample point 212*n* and the bottom 114 of the borehole. Thus, the bending tool face can define the set of possible azimuth values that can be used to form the possible azimuth values for the above estimated bit inclination and azimuth values used to determine the DLS.

Generally, some of the teachings herein are reduced to an algorithm that is stored on machine-readable media. The algorithm is implemented by the computer processing system and provides operators with desired output.

In support of the teachings herein, various analysis components may be used, including digital and/or analog systems. The digital and/or analog systems may be included, for example, in the processing unit 110. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing for aspects of the teachings herein. For example, a power supply (e.g., at least one of a generator, a remote supply and a battery), cooling component, heating component, motive force (such as a translational force, propulsional force, or a rotational force), digital signal processor, analog signal processor, sensor, magnet, antenna, transmitter, receiver, transceiver, controller, optical unit, electrical unit or electromechanical unit may be included in support of the various aspects discussed herein or in support of other functions beyond this disclosure.

Elements of the embodiments have been introduced with either the articles "a" or "an." The articles are intended to mean that there are one or more of the elements. The terms "including" and "having" and their derivatives are intended to be inclusive such that there may be additional elements other than the elements listed. The term "or" when used with a list of at least two items is intended to mean any item or combination of items.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A computer-based method for estimating an inclination and azimuth at a bottom of a borehole, the borehole including a drill string with a bit at its end, the method comprising:

forming a last survey point including a last inclination and a last azimuth;

receiving at a computing device an actual bending moment value and a near bit inclination measurement from one or more sensors in the borehole; and forming a plurality of sets of estimated inclination and azimuth values based on the last inclination and last azimuth;

forming an estimated bending moment value for each of the plurality of sets of estimated inclination and azimuth values;

comparing the actual bending moment value to the estimated bending moment value formed for each of the sets;

selecting an estimated bending moment value closest to the actual bending moment value;

selecting a set of estimated inclination and azimuth values corresponding to the selected estimated bending moment value as the estimated inclination and azimuth; and changing a trajectory of the drill string based on the selected set;

wherein the plurality of sets of estimated inclination and azimuth values are limited to existing in a plane defined by the near bit inclination measurement.

2. The method of claim 1, wherein the one or more sensors are included in a sensor sub located near the bottom of the borehole.

3. The method of claim 1, further comprises:

determining a build rate based on the estimated inclination and azimuth.

4. The method of claim 1, further comprises:

determining a turn rate based on the estimated inclination and azimuth.

5. The method of claim 1, wherein the computing device is located at a surface location.

6. A computer program product for estimating an inclination and azimuth at a bottom of a borehole, the borehole including a drill string with a bit at its end, the computer program product including a non-transitory tangible storage medium readable by a processing circuit and storing instructions for execution by the processing circuit for performing a method comprising:

receiving a last survey point including a last inclination and a last azimuth;

receiving a bending moment value and a near bit inclination measurement from one or more sensors in the borehole; and forming a plurality of sets of estimated inclination and azimuth values based on the last inclination and last azimuth;

forming an estimated bending moment for each of the sets of estimated inclination and azimuth values;

comparing the bending moment value to the estimated bending moment values formed for each of the sets;

selecting an estimated bending moment value closest to the bending movement value;

selecting a set of estimated inclination and azimuth corresponding to the selected estimated bending moment as the estimated inclination and azimuth; and changing a trajectory of the drill string based on the selected set;

wherein the plurality of sets of estimated inclination and azimuth values are limited to existing in a plane defined by the near bit inclination measurement.

7. The computer program product of claim 6, wherein the method further comprises:

determining a build rate based on the estimated inclination and azimuth.

8. The computer program product of claim 6, wherein the method further comprises:

determining a turn rate based on the estimated inclination and azimuth.

* * * * *